US006036072A

United States Patent [19]

Lee

[11] Patent Number: 6,036,072

[45] Date of Patent: Mar. 14, 2000

[54] NAILER MAGAZINE

[75] Inventor: Yun-Chung Lee, Taipei Hsien, Taiwan

[73] Assignee: De Poan Pneumatic Corporation, Taipei Hsien, Taiwan

[21] Appl. No.: 09/181,057

[22] Filed: Oct. 27, 1998

[51] Int. Cl.[7] ..... B25C 1/04

[52] U.S. Cl. ..... 227/120

[58] Field of Search ..... 227/120, 130, 227/123, 156, 127

[56] References Cited

U.S. PATENT DOCUMENTS

| | | | |
|---|---|---|---|
| 4,389,012 | 6/1983 | Grikis et al. | 227/120 |
| 4,524,896 | 6/1985 | Morrell, Jr. | 227/120 |
| 5,335,800 | 8/1994 | Liu | 227/120 |
| 5,588,577 | 12/1996 | Chen | 227/120 |
| 5,626,274 | 5/1997 | Shkolnikov et al. | 227/120 |
| 5,632,431 | 5/1997 | Lin | 227/120 |
| 5,730,350 | 3/1998 | Lin | 227/120 |

*Primary Examiner*—Scott A. Smith
*Attorney, Agent, or Firm*—Pro-Techtor International Services

[57] ABSTRACT

A nailer magazine, comprising: a magazine body, having a main axis and a free rear end; a gliding plate, glidingly movable into the magazine body into a mounted position and out of the magazine body through the rear end thereof; a holding plate, attached to the rear end of the magazine body; and a blocking system, attached to the rear end of the gliding plate for holding the gliding plate in the mounted position. The blocking system further comprises: a main body; a gliding element; a spring; and a blocking element. The gliding element is glidingly movable inside the main body in a direction perpendicular to the main axis, having an externally accessible upper end to be pushed manually into the main body. The spring is laid into the main body, pushing the gliding element towards the upper end thereof. The blocking part is connected to the gliding element and extends out of the main body for engaging with the holding plate when the gliding plate is in the mounted position, so as to fix the gliding plate therein.

4 Claims, 11 Drawing Sheets

NAILER MAGAZINE

BACKGROUND OF THE INVENTION

1. Field of the Invention

The present invention relates to a nailer magazine, particularly to a nailer magazine with nails arranged in a row.

2. Description of Related Art

In conventional nailer magazines, nails are arranged in rows or in rolls. The arrangement in rows is mainly used in relatively small nailers. As shown in FIG. 11, a conventional magazine 1 with nails arranged in rows is fast and easily refilled. The magazine 1 has a fixed magazine body 2 with a rear end and a gliding plate 3, which is glidingly movable out of and into the magazine body 2 through the rear thereof. Grooves 4 in the magazine body 2 accommodate a row of nails. For inserting the row of nails in the grooves 4, the gliding plate 3 is moved out of the magazine body 2 and, after inserting the row of nails, back into the magazine body 2 to put the nails in place. A blocking system 5 at the rear of the magazine body 2 fixes the gliding plate 3 in this position. The blocking system 5 has a blocking lever 6 with a long lever arm 7. A user, for releasing the gliding plate 3, presses on the lever arm 7. The blocking system 5 is held in a casing 8, mounted at the rear of the magazine body 2.

The design described above requires some additional length of the nailer magazine, which is not usable for storing nails, in order to accommodate the blocking part. Thus the capacity of the nailer magazine is limited.

SUMMARY OF THE INVENTION

It is therefore the main object of the present invention to provide a nailer magazine of reduced external length and increased capacity of nails.

The present invention can be more fully understood by reference to the following description and accompanying drawings.

DETAILED DESCRIPTION OF THE PREFERRED EMBODIMENTS

Figure 1:
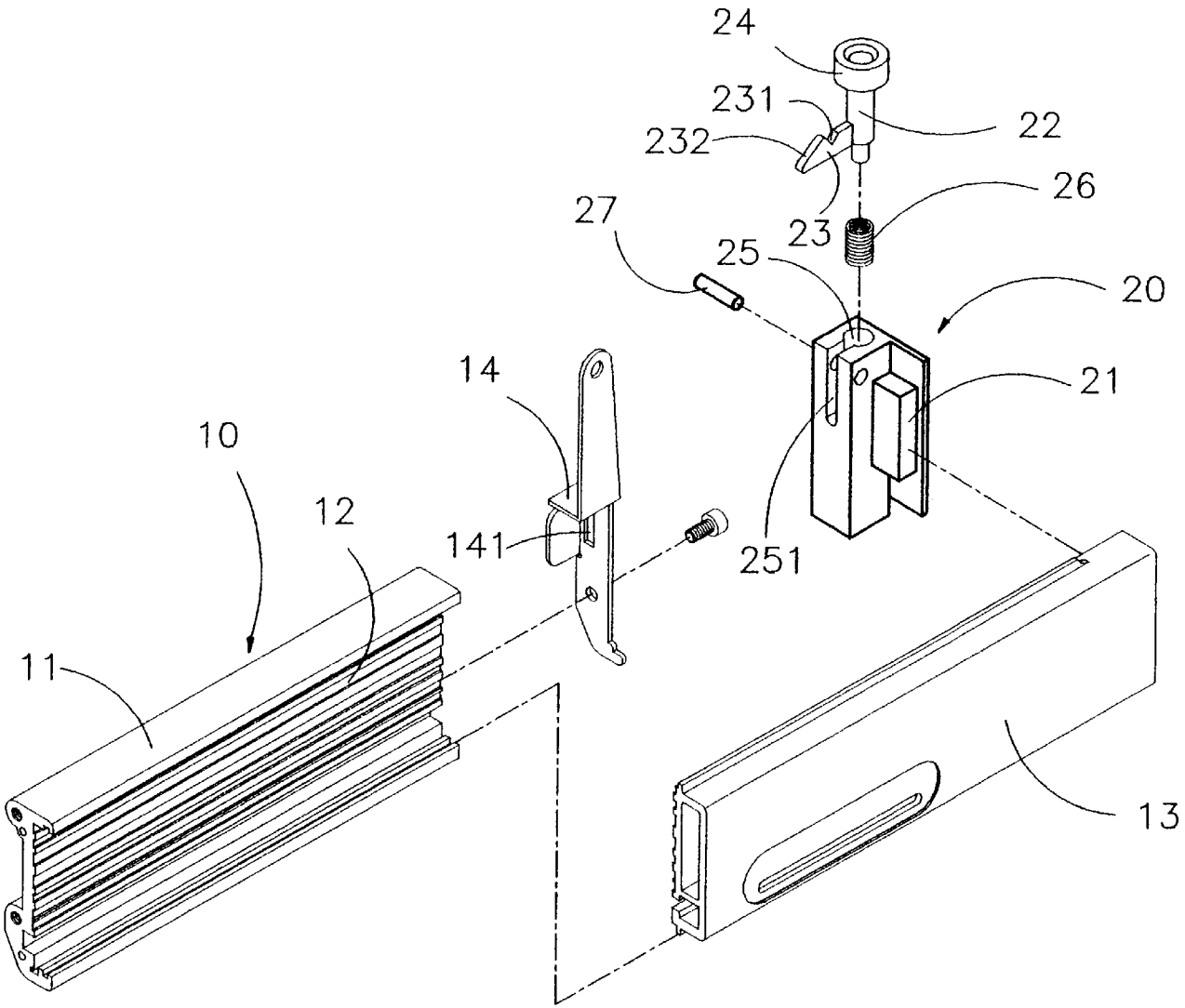
FIG. 1 is an exploded perspective view of the nailer magazine of the present invention in the first embodiment.

As shown in FIG. 1, the nailer magazine of the present invention in a first embodiment comprises a magazine 10 and a blocking system 20. The magazine 10 further comprises: a magazine body 11, having a main axis, an inner side with several grooves 12 and a rear end, to which a holding plate 14 is attached; and a gliding plate 13, having a rear end and being glidingly movable within the magazine body 11 back and forth along the main axis. The grooves 12 serve to accommodate a row of nails. For inserting the row of nails in the grooves 12, the gliding plate 13 is moved out of the magazine body 11 into a loading position. After inserting the row of nails, the gliding plate 13 is moved back into the magazine body into a mounted position to put the nails in place. The blocking system 20 is attached to the rear end of the gliding plate 13. In the mounted position of the gliding plate 13 the blocking system 20 engages with the holding plate 14.

The main characteristic of the present invention lies in a blocking element moving towards lateral sides of the blocking system 20, allowing to reduce the length of the magazine 10 and to increase the capacity thereof.

As shown in FIGS. 1–6, the blocking system 20 comprises: a main body 21, fixed on the rear end of the gliding plate 13 and having an upper end; a gliding pin 22, glidingly movable inside the main body 21 in a direction perpendicular to the main axis of the magazine 10, which defines a vertical direction; a blocking part 23, attached to the pin 22 and extending out of the main body 21 close to the upper end thereof; a spring 26; and a bolt 27. A vertical opening 25 extends from the upper end of the main body 21 towards the inside thereof, serving as a gliding path for the gliding pin 22. A gap 251 is cut into the main body 21, extending downward from the upper end thereof, allowing the blocking part 23 to move freely along the gliding pin 22 within the main body 21 while extending out of the main body 21. The spring 26 is laid into the opening 25, pushing the gliding pin upward, out of the main body 21.

Figure 2:
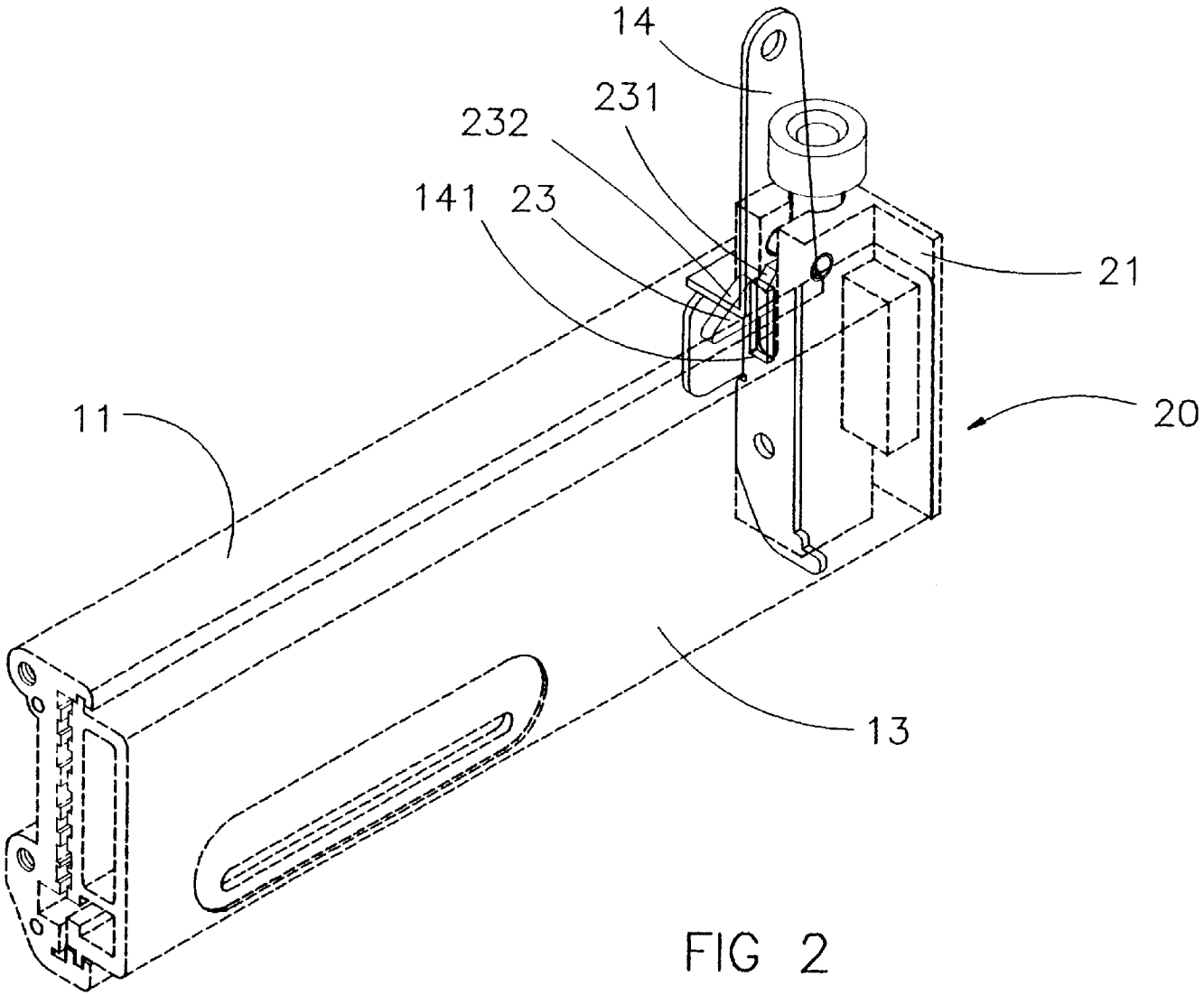
FIG. 2 is a perspective view of the nailer magazine of the present invention in the first embodiment, with the gliding plate in the mounted state.
Figure 5:
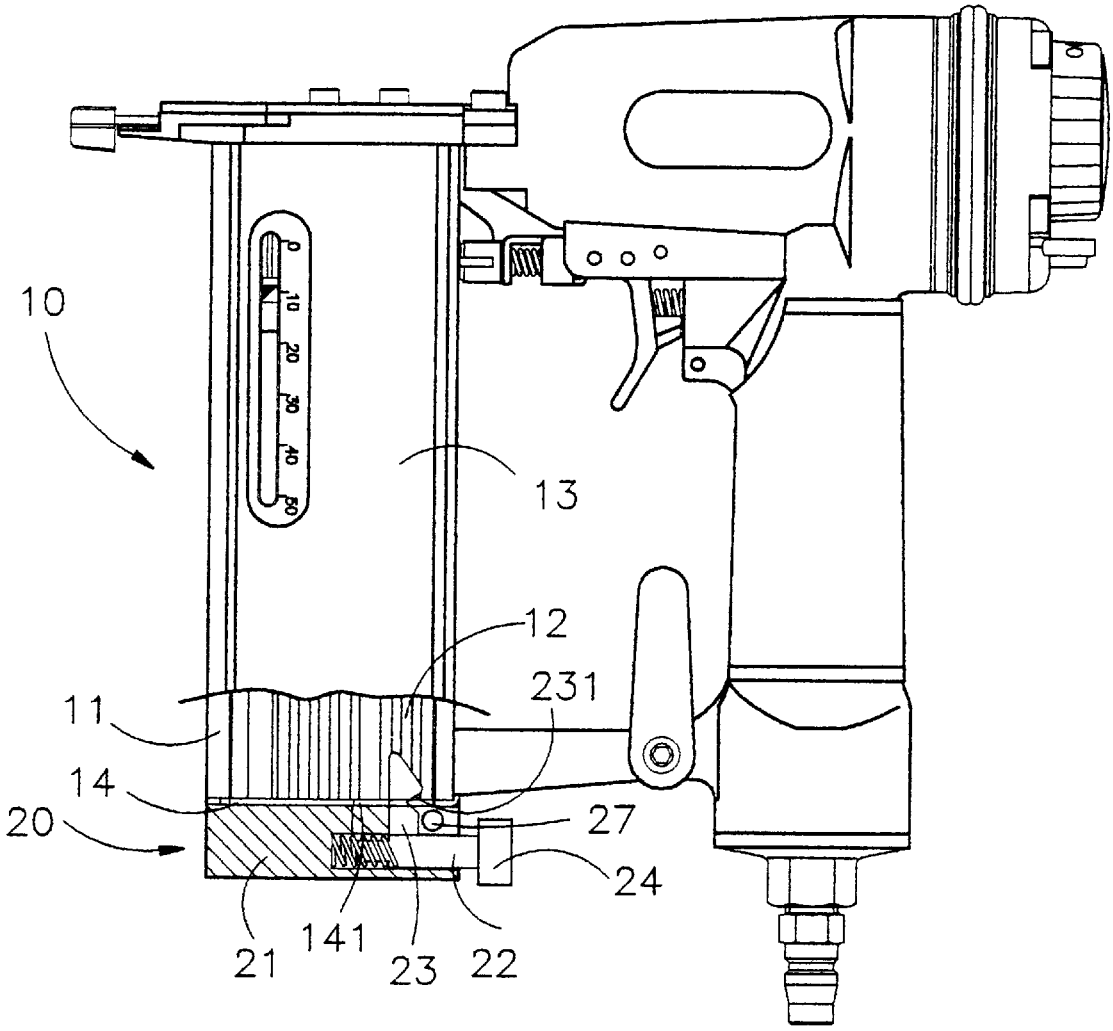
FIG. 5 is a side view of the nailer magazine of the present invention in the first embodiment in conjunction with part of a nailer.
Figure 6:
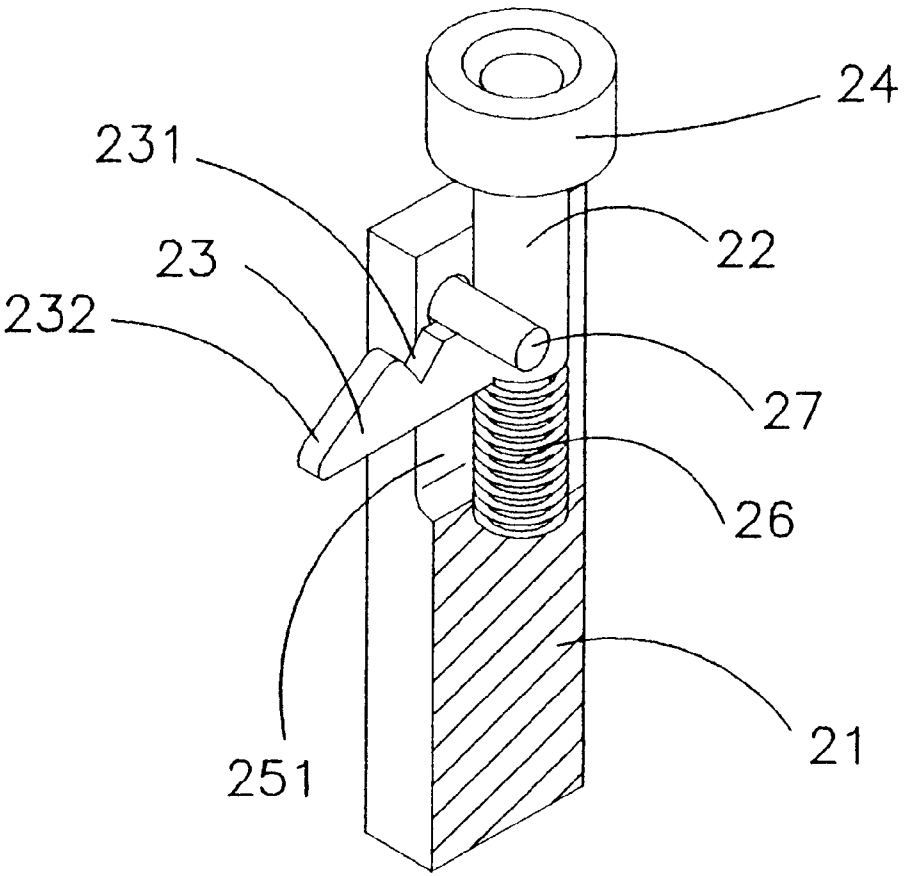
FIG. 6 is a perspective view of the blocking system of the present invention in the first embodiment.
Figure 7:
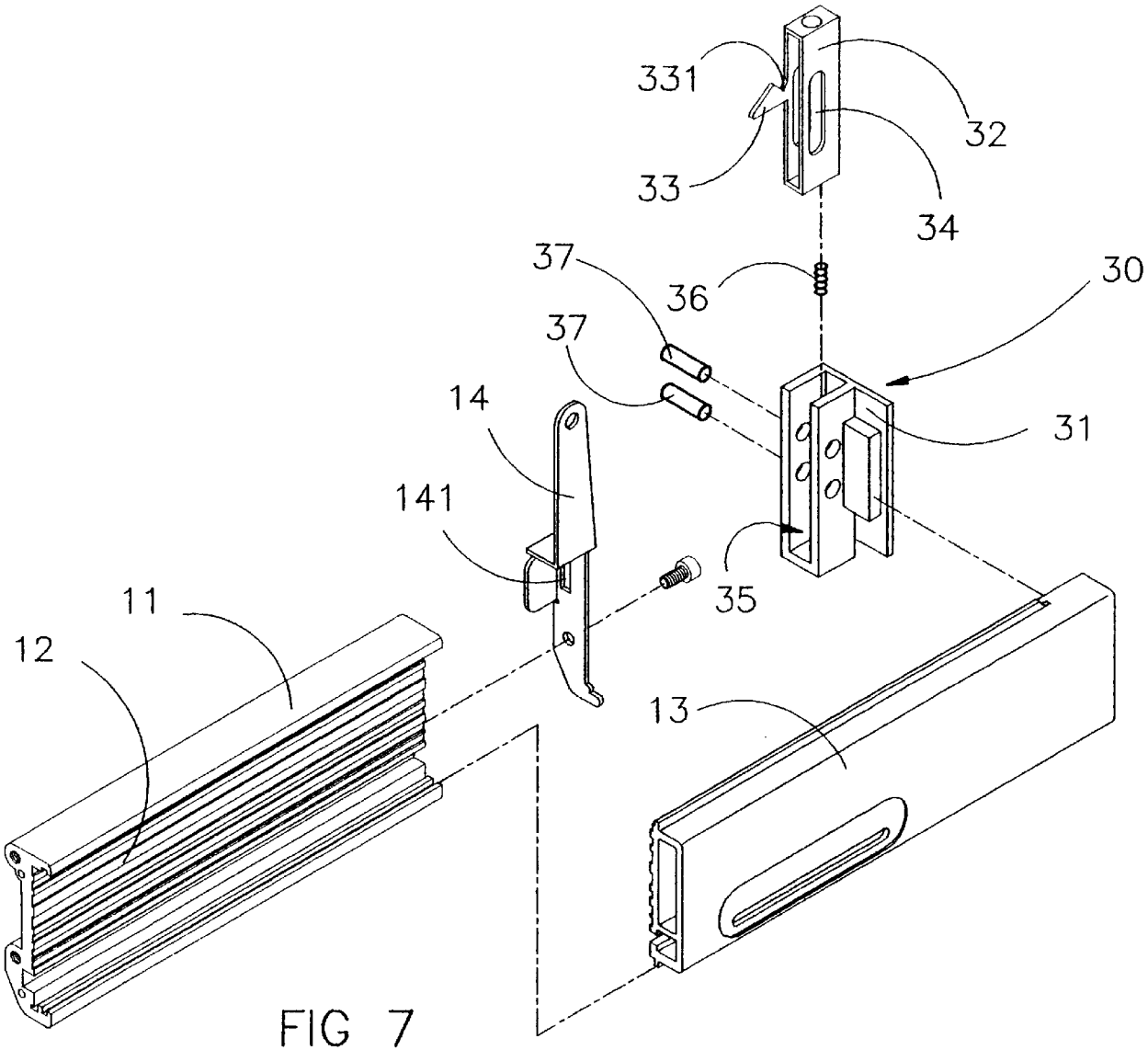
FIG. 7 is an exploded perspective view of the nailer magazine of the present invention in the second embodiment.

Referring to FIGS. 1, 2 and 5, the holding plate 14 has a hole 141. With the gliding plate 13 in the mounted position inside the main body 11, the blocking part 23 passes through the hole 141. The blocking part has an edge with a hook 231 and a tapered front end 232. When the spring 26 pushes the gliding pin 22 upward the hook 231 is held by the edge of the hole 141, such that the blocking part 23 stays engaged with the holding plate 14, fixing the gliding plate 13 in position. The tapered front end 232 allows the blocking part 23 to enter the hole 141 of the holding plate 141, with the hook 231 being engaged therein. The bolt 27 bridges the gap 25 above the blocking part 23, holding the gliding pin 22 with the blocking part 23 in the main body 21.

Figure 3:
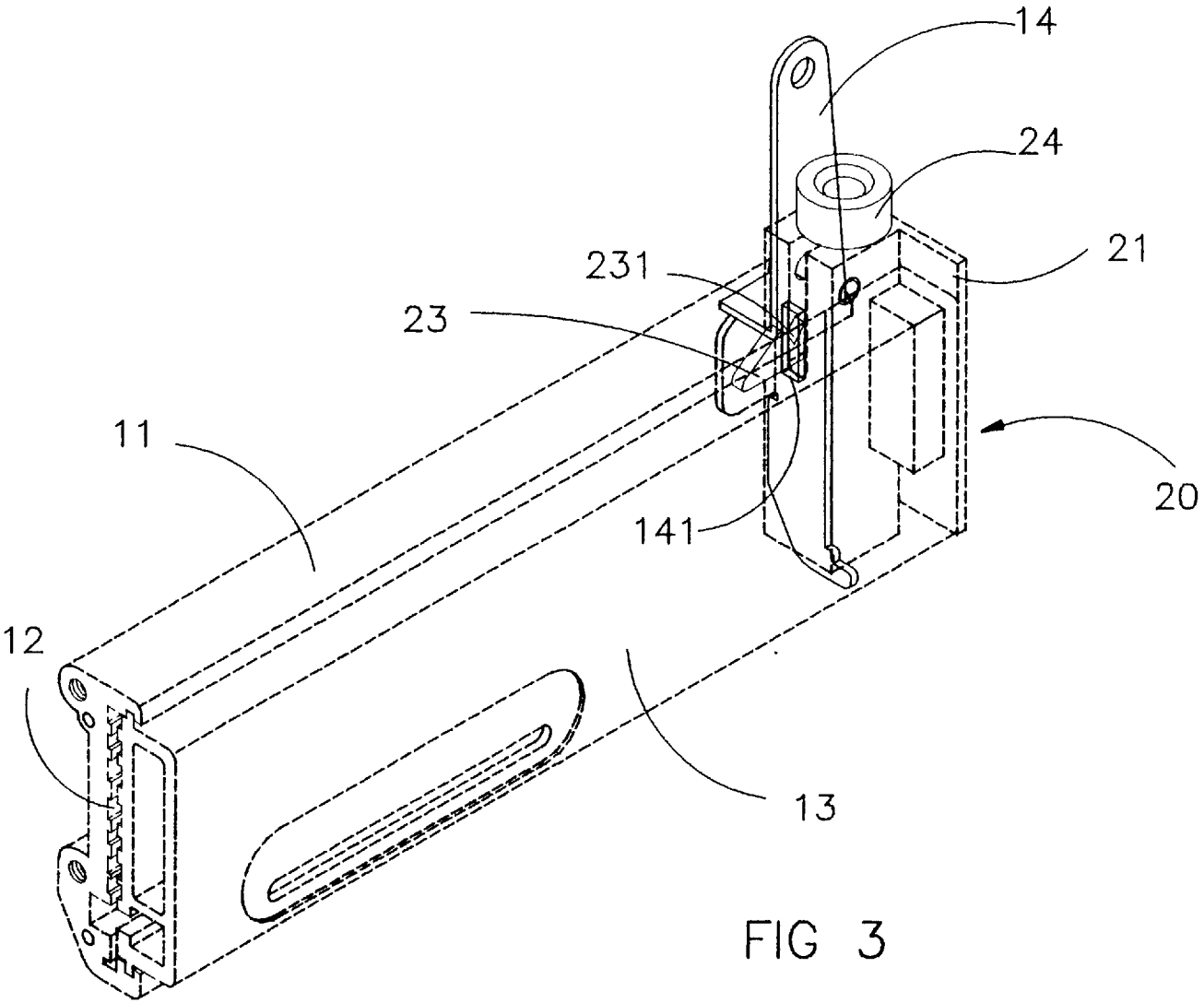
FIG. 3 is a perspective view of the nailer magazine of the present invention in the first embodiment, with the blocking part disengaging.
Figure 4:
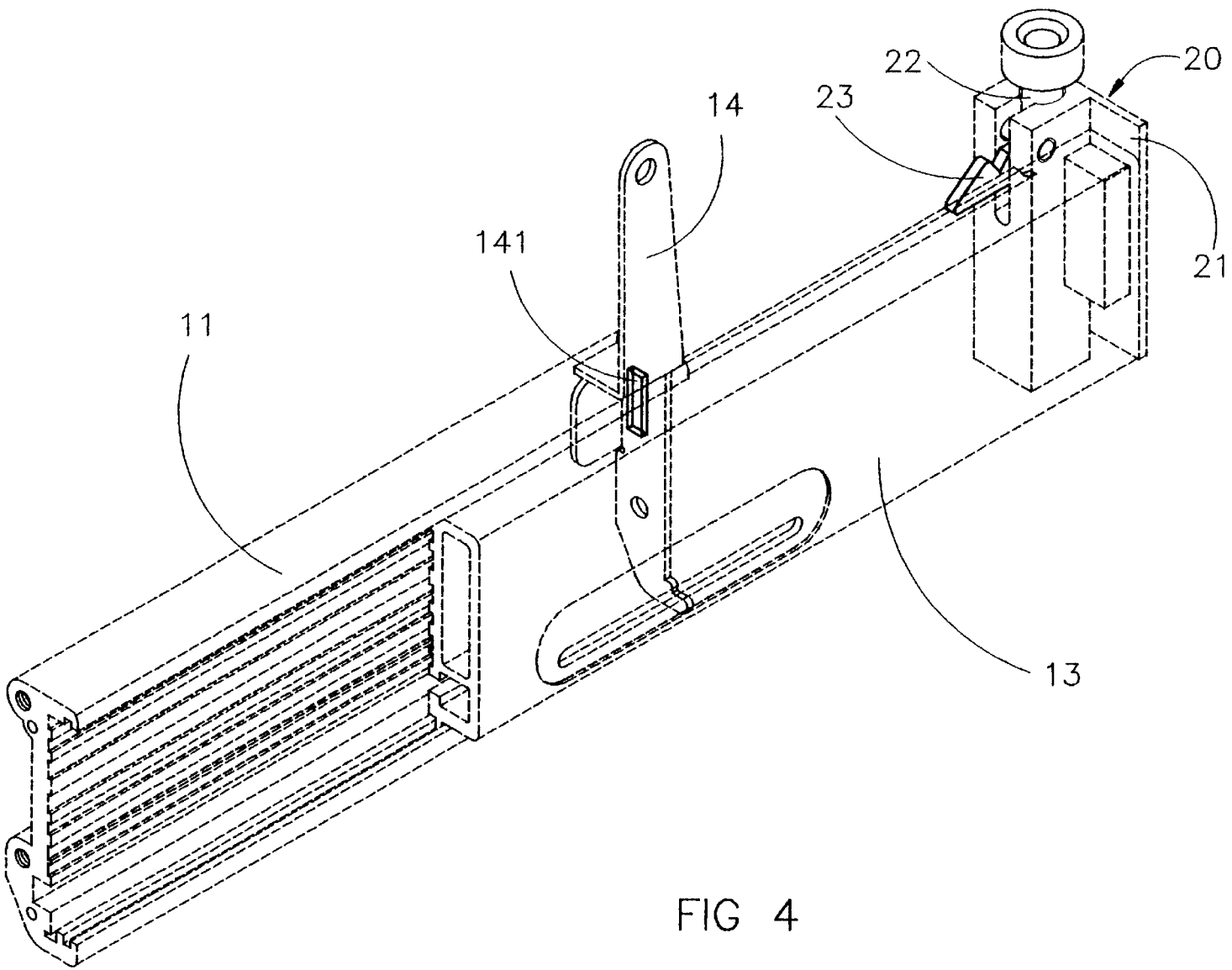
FIG. 4 is a perspective view of the nailer magazine of the present invention in the first embodiment, with the gliding plate moving to the loading state.

The upper end of the gliding pin 22 carries a head 24, allowing a user to push the gliding pin 22 manually downward into the main body 21. As shown in FIG. 3, pressing on the head 24, thus pushing the gliding pin 22 with the blocking part 23 downward causes the blocking part 23 to disengage from the holding plate 14, such that the gliding plate 13 is no longer fixed and may be pulled to the rear, out of the magazine body 11 (as shown in FIG. 4).

Referring to FIG. 5, since the blocking system 20 with the gliding pin 22 and the blocking part 23 are oriented perpendicular to the main axis of the magazine body 11, the blocking system 20 adds little to the length of the magazine body 11, allowing for a magazine 10 of a smaller length, as compared to a conventional magazine. The capacity of the magazine is increased as well.

Referring to FIGS. 7–10, the nailer magazine of the present invention in a second embodiment has a blocking system 30, which comprises: a main body 31, fixed on the rear end of the gliding plate 13 and having an upper end; a gliding element 32, made of punched metal, roughly of rectangular shape and glidingly movable inside the main body 31 in the vertical direction; a blocking part 33, attached to the element 32 and extending out of the main body 31 close to the upper end thereof; a spring 36; and two bolts 37. A vertical opening 35 is cut into the main body 31, open towards the upper and front sides thereof and serving as a gliding path for the gliding element 32. The spring 36 is laid into the opening 35, between the gliding element 32 and the main body 31, pushing the gliding pin upward. Two vertical elongated guiding holes 34 are cut into the lateral sides of the gliding element 32. The bolts 37 bridge the opening 35 above the blocking part 33, passing through the guiding holes 34 and thus guiding the gliding element 32 with the blocking part 33 in the main body 31, at the same time preventing the gliding element 32 from leaving the main body 31.

Figure 8:
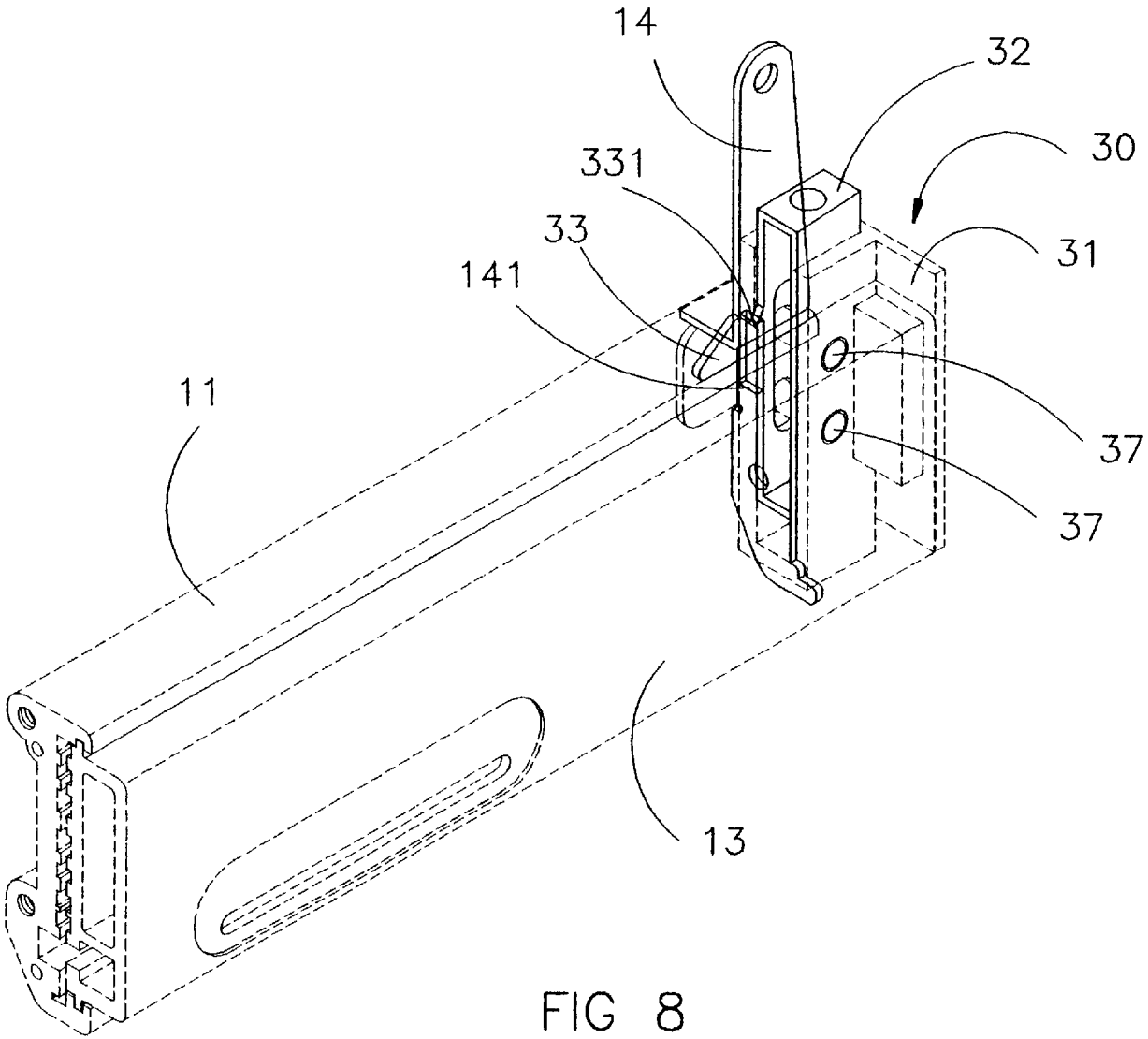
FIG. 8 is a perspective view of the nailer magazine of the present invention in the second embodiment, with the gliding plate in the mounted state.
Figure 9:
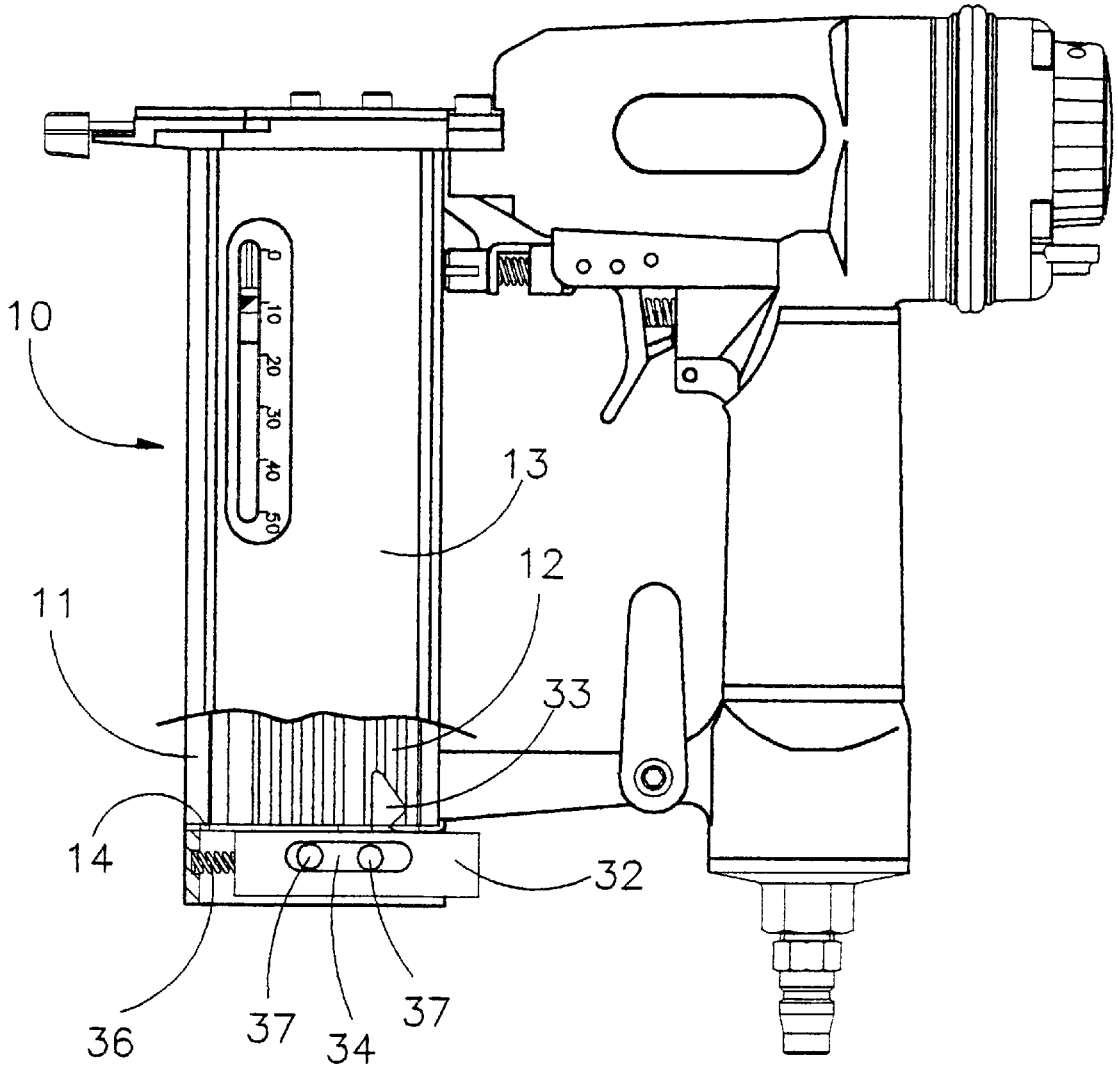
FIG. 9 is a side view of the nailer magazine of the present invention in the second embodiment in conjunction with part of a nailer.
Figure 10:
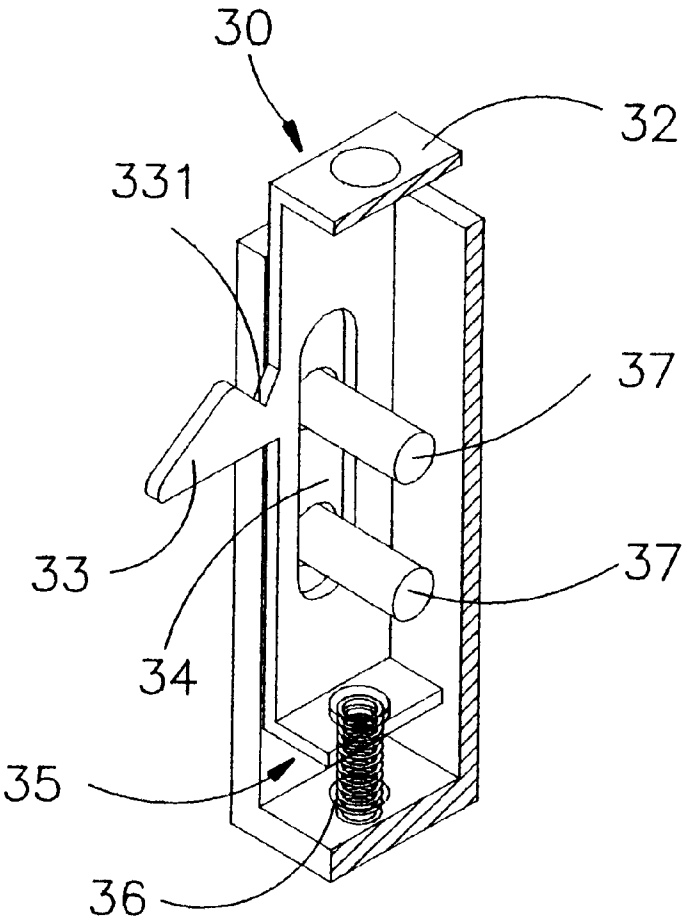
FIG. 10 is a perspective view of the blocking system of the present invention in the second embodiment.
Figure 11:
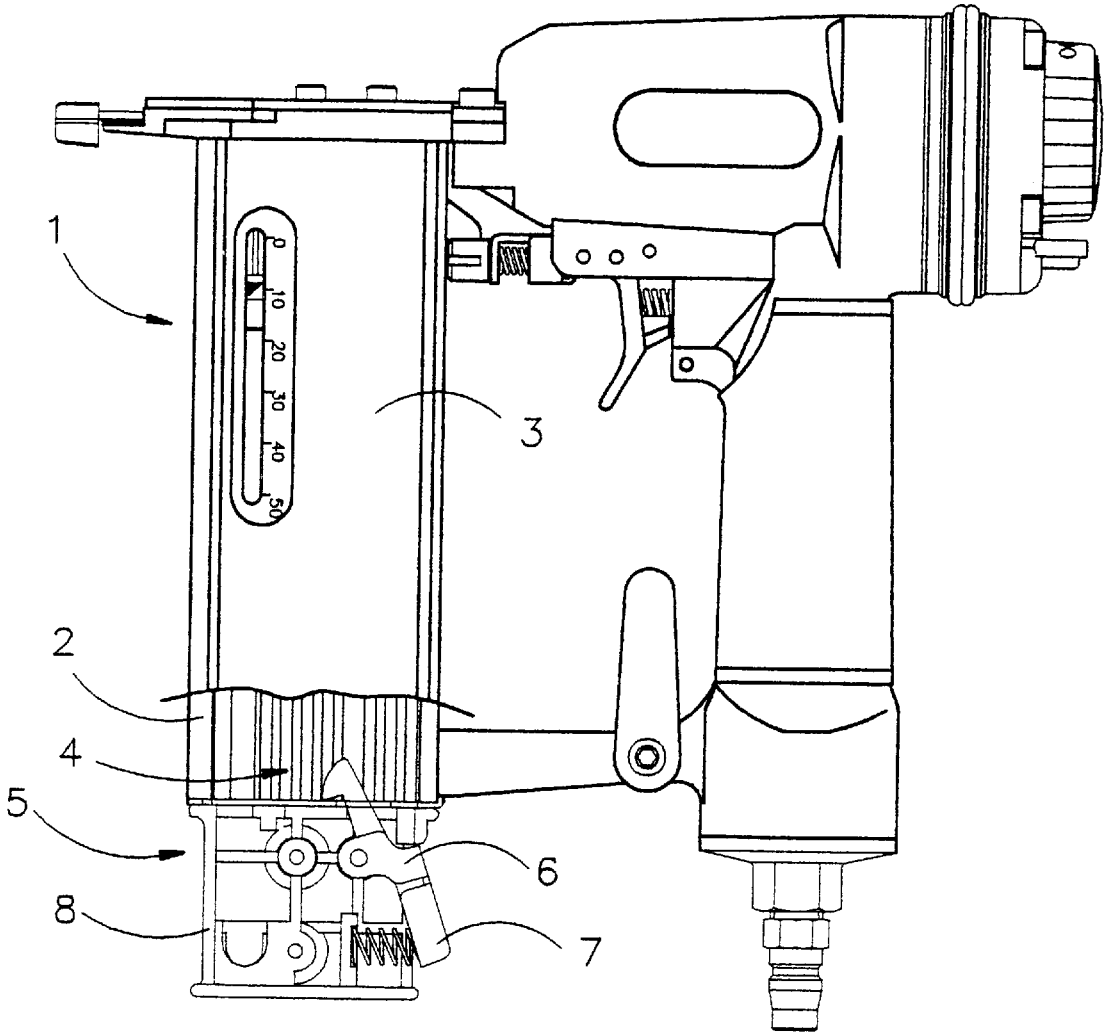
(PRIOR ART) FIG 11
FIG. 11 (prior art) is a side view of a conventional nailer magazine in conjunction with part of a nailer.

Referring to FIGS. 8–10, the blocking part has an edge with a hook 331 for engaging with the hole 141 of the holding plate 14 and holding the gliding plate 13 in the mounting position. For releasing the gliding plate 13 from the mounted position, the user pushes the gliding element 32 into the main body 31, such that the blocking part 33 disengages from the hole 141 of the holding plate 14.

As shown in FIG. 9, the blocking system 30 of the present invention in the second embodiment works like the blocking system 20 of the first embodiment. Since the gliding element 32 with the blocking part 33 is made of punched metal, weight and assembly cost are further reduced.

While the invention has been described with reference to preferred embodiments thereof, it is to be understood that modifications or variations may be easily made without departing from the spirit of this invention which is defined by the appended claims.

I claim:

1. A nailer magazine, comprising:

a magazine body, having a main axis and a free rear end;

a gliding plate, glidingly movable into said magazine body into a mounted position and out of said magazine body through said rear end thereof and having a rear end;

a holding plate, attached to said rear end of said magazine body; and a blocking system, attached to said rear end of said gliding plate for holding said gliding plate in said mounted position and further comprising a main body, a gliding element, glidingly movable inside said main body in a direction perpendicular to said main axis and having an externally accessible upper end for being pushed into said main body, a spring, laid into said main body, pushing said gliding element towards said upper end thereof, and a blocking part, connected to said gliding element and extending out of said main body for engaging with said holding plate when said gliding plate is in said mounted position, so as to fix said gliding plate therein.

2. A nailer magazine according to claim 1, wherein said blocking part has a tapered far end for easy engaging with said holding plate.

3. A nailer magazine according to claim 1, wherein said gliding element is a cylindrical pin and said blocking part is a plate attached thereto.

4. A nailer magazine according to claim 1, wherein said gliding element is made of punched metal, with said blocking part being integrated.

* * * * *